US005582449A

United States Patent [19]

Weyerstall

[11] Patent Number: 5,582,449

[45] Date of Patent: Dec. 10, 1996

[54] AUTOMOBILE DOOR LOCK

[75] Inventor: Bernd Weyerstall, Wuppertal, Germany

[73] Assignee: Bomoro Bocklenberg & Motte Gmbh & Co. KG, Wuppertal, Germany

[21] Appl. No.: 348,253

[22] Filed: Nov. 28, 1994

[30] Foreign Application Priority Data

Nov. 26, 1993 [DE] Germany ..... 9318145 U
Jul. 14, 1994 [EP] European Pat. Off. ..... 94110981

[51] Int. Cl.[6] ..... E05B 9/00

[52] U.S. Cl. ..... 292/337; 292/216

[58] Field of Search ..... 292/337, 216, 292/DIG. 38, DIG. 65, DIG. 14, DIG. 43

[56] References Cited

U.S. PATENT DOCUMENTS

| | | | |
|---|---|---|---|
| 4,492,395 | 1/1985 | Yamada | 292/DIG. 65 X |
| 4,538,845 | 9/1985 | Yamada | 292/216 |
| 4,762,349 | 8/1988 | Ikeda | 292/216 |
| 4,902,058 | 2/1990 | Ohhashi et al. | 292/337 |
| 4,904,004 | 2/1990 | Bartczak | 292/DIG. 38 X |
| 4,904,006 | 2/1990 | Hayakawa et al. | 292/DIG. 38 X |
| 5,158,330 | 10/1992 | Weyerstall et al. | 292/144 |
| 5,409,273 | 4/1995 | Claar et al. | 292/DIG. 14 X |
| 5,411,302 | 5/1995 | Shimada | 292/DIG. 65 X |

FOREIGN PATENT DOCUMENTS

| | | | |
|---|---|---|---|
| 0364936 | 4/1990 | European Pat. Off. . | |
| 4026381 | 8/1990 | Germany . | |
| 1230878 | 9/1989 | Japan | 292/337 |

*Primary Examiner*—Rodney M. Lindsey
*Assistant Examiner*—Monica E. Millner
*Attorney, Agent, or Firm*—Sixbey, Friedman, Leedom & Ferguson, P.C.; David S. Safran

[57] ABSTRACT

An automobile door lock, having a metallic base plate (2), which, preferably, has an inlet slot (1) for a lock retainer, further having lock elements, like a ratchet (3) and a ratchet pawl (4) disposed at the base plate, further comprising a lock mechanism having various operating levers (5), as well as a one-piece housing (6) made of molded fiber-reinforced synthetic material and which is firmly connected with the base plate (2) by bolts. The cost-effectiveness of this automobile door lock is enhanced in by the housing (6) is designed without a metallic cover plate the side opposite the base plate (2), and also in that all of operating levers (5) of the lock mechanism are carried by either the housing (6) or the base plate (2).

7 Claims, 1 Drawing Sheet

AUTOMOBILE DOOR LOCK

BACKGROUND OF THE INVENTION

1. Field of the Invention

The invention relates to an automobile door lock, having a metallic base plate, which, preferably, is angular and has an inlet slot for a striker, and also having lock elements, like a ratchet and a ratchet pawl, disposed at the base plate; further comprising a lock mechanism having various operating levers, as well as a one-piece housing, which may be made of molded fiber-reinforced synthetic material, which is firmly connected with the base plate, more particularly, is connected therewith by bolts.

2. Description of Related Art

The known automobile door lock (U.S. Pat. No. 4,538,845), on which the invention is based, has a one-piece plastic body, made by an injection molding process, which is covered on the back side, facing away from the base plate, by a metallic cover plate. The body forths a central support wall which is provided with several openings, on one side of which the lock retainer, ratchet, and the pawl are disposed in corresponding recesses to form a catch element. On the other side of the body, there are bearing sleeves or pins which support a series of operating levers in a positionally correct manner. Individual operating levers, here, are made of molded plastic material. By tightening the back cover plate to the base plate, the plastic body disposed inbetween is fixed, and the lock elements contained therein, on one hand, and the operation levers of the lock mechanism, on the other hand, are adjusted so as to be positionally correct.

SUMMARY OF THE INVENTION

It has been shown, however, that the known automobile door lock, now as before, is not sufficiently cost-effective, and accordingly, it is the primary objective of the present invention to increase the cost-effectiveness of the known automobile door lock.

This objective is achieved by providing a housing which does not have a cover plate on the back side, facing away from the base plate, and further, by mounting all of the operating levers of the lock mechanism to or on either the housing or the base plate. In accordance with the provisions of the inventive design, the metallic cover plate is entirely dispensed with, and the bearing points of all operating levers are now primarily shifted to the housing. If desired, mounting of the operating levers is supported by protrusions or connecting plates on the base plate.

The prior art automobile door lock can be equipped, of course, with a pneumatic servo drive, which is known (German reference C 42 05269.) However, the cost-effectiveness of the inventive automobile door lock is particularly enhanced in that the servo drive cylinder of the pneumatic servo drive is molded as a one-piece plastic unit with the housing. This is a particular feature of the invention and is facilitated by the elimination of the metallic cover plate.

Besides pneumatic servo drives, electrical servo drives (electric and electromagnetic solenoid drives) are known to be conventional alternatives. As with pneumatic servo drives, here too, the regularly used servo drive housing can be molded of plastic material as a one-piece unit with the door lock housing as a whole.

The metallic cover plate in the automobile door lock known from the prior art, has at least one support arm, which angularly projects from a plane which is parallel to the plane comprising the inlet slot. To be more specific, the metallic cover plate, in accordance with the state of the art, is angularly chamfered. In the example of the present invention, a corresponding configuration is particularly realized in that at least one angularly projecting support arm is provided on the housing, which arm, preferably, can cooperate with a servo element of the servo drive.

Finally, it is advantageous that the housing is provided with mountings for plastic bearing pins, which may be molded-on as one-piece therewith.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENTS

Figure 1:
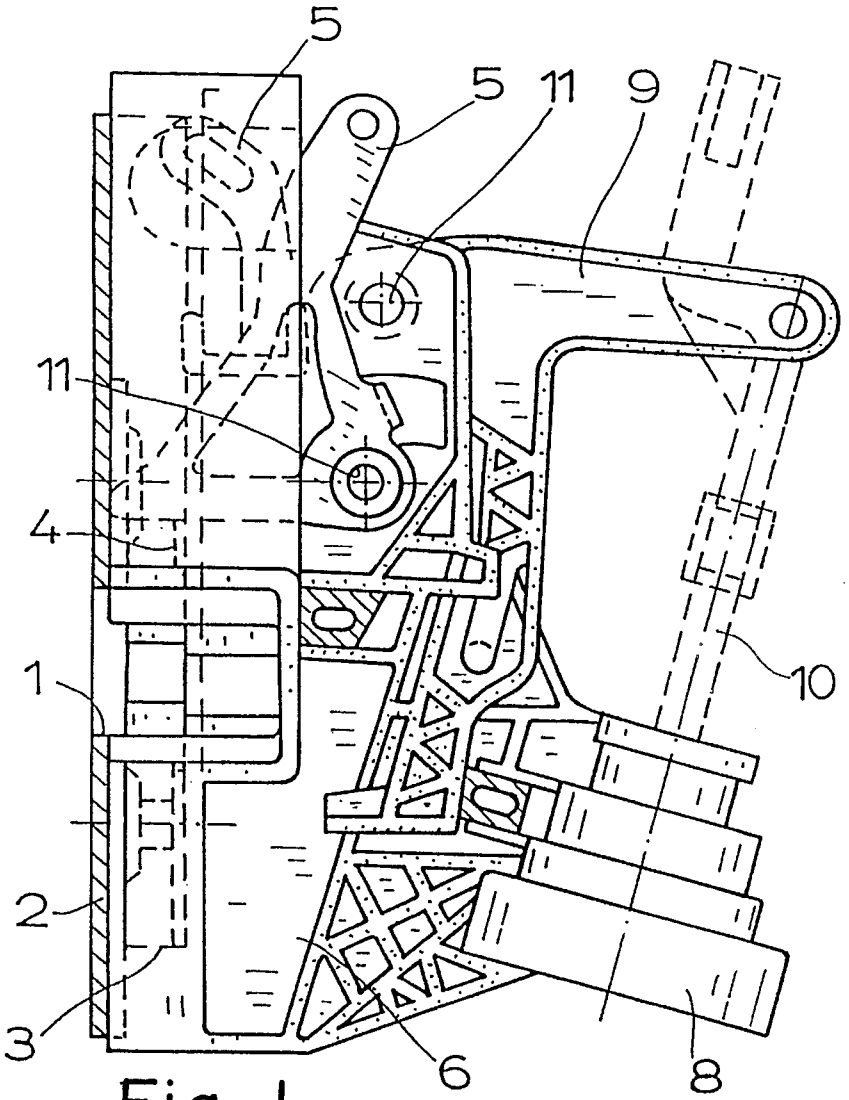
FIG. 1 shows an automobile door lock, viewed from the feed side of its entry slot.

The automobile door lock depicted in FIG. 1 has a base plate 2 which, preferably, is angular and metallic, and has an inlet slot 1 for a striker (not shown). As diagrammatically indicated in FIG. 1, there are lock elements, like a ratchet 3, e.g., a pivotal catch and a ratchet pawl 4, pivotally disposed on base plate 2. The metallic support elements on base plate 2 provide the necessary stability for support, and the base plate 2, as a whole, provides resistance against high shear forces.

Figure 2:
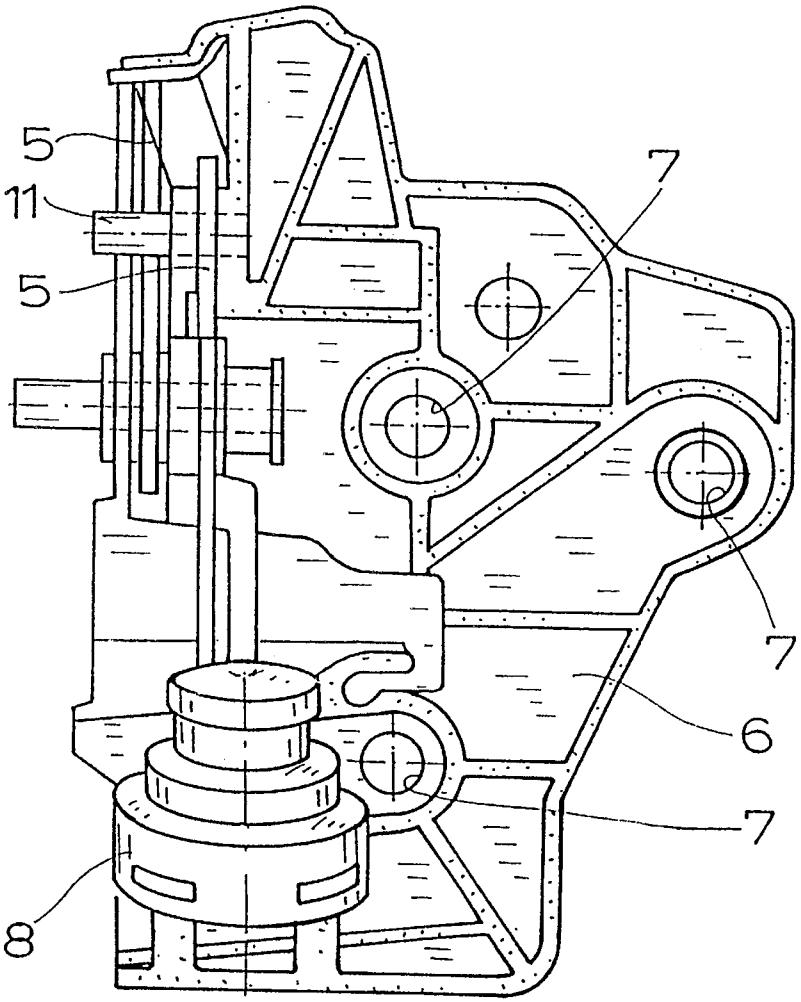
FIG. 2 shows the automobile door lock of FIG. 1, as seen when viewed from the right in FIG. 1.

It is further schematically indicated in FIGS. 1 and 2 that there is a lock mechanism having various operating levers 5, whose individual functions are not of importance here being conventional parts of existing lock structure. Furthermore, a one-piece housing 6 is provided, which may be molded of fiber-reinforced synthetic material, produced, for example, by an injection molding process. Housing 6 is firmly connected with base plate 2 by screw bolts (not shown), three openings 7 for screw bolts which serve to connect base plate 2 with housing 6 and the automobile door lock, as a whole, with the automobile door being shown in FIG. 2.

FIGS. 1 and 2, in combination, show that housing 6 does not have a metallic cover plate on the back, i.e., the side opposite support plate 2, and also, that all operating levers 5 of the lock mechanism primarily are disposed on housing 6, or, may be supported by base plate 2. While retaining the one-piece synthetic material housing 6 as a support for the operating levers 5 of the lock mechanism, as well as for ratchet 3 and ratchet pawl 4, housing 6 with base plate 2 becomes the single structural element of the automobile door lock, as a whole. In other words, it also assumes the function of the metallic cover plate used heretofore. This fact leads to considerable advantages in manufacturing technique, and consequently, results in substantially lower costs.

It is known from the prior art, to use a central interlocking control having a pneumatic servo drive (see, e.g., German Patent 42 05 269). In such a pneumatic servo drive, the servo drive cylinder 8 frequently is formed of injection molded synthetic plastic material. The construction of the inventive automobile door lock with a housing 6, which now assumes the function of the prior metallic cover plate, provides the opportunity to mold the servo drive cylinder 8 of synthetic plastic material, as one-piece with housing 6. This applies to the main portion of the servo drive cylinder 8, and of course, a cover plate, likewise, made of synthetic material, has to be inserted into the drive cylinder 8.

In a known electrical servo drive, which is a conventional alternative, a servo drive housing consisting of synthetic material could be molded as a one-piece unit corresponding to the housing of the door lock.

In the general part of the description, it has already been pointed out that, in accordance with the state of the art, the metallic base plate frequently has an angular projecting support arm, or, respectively, is angularly chamfered in order to provide a fastening site for operation levers 5 of the lock mechanism. In the depicted and preferred example (FIG. 1) this has been considered in that, at housing 6, at least one angularly projecting support arm 9 is provided, which, preferably, cooperates with a control element 10 of the servo motor drive.

In the example depicting the inventive automobile door lock, it applies again that housing 6 has mountings 11 for synthetic material pins, and/or is provided with one-piece molded-on plastic bearing pins. Here again, individual operation levers 5, which do not undergo heavy mechanical stress, can be made as molded components of synthetic material. Accordingly, an automobile door lock, with far greater cost-effectiveness, which meets all requirements of security technology, is obtained.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. In an automobile door lock of the type having a metallic base plate with an inlet slot for a striker, lock elements including a ratchet and ratchet pawl disposed on the base plate, a lock mechanism having multiple operating levers, and a one-piece housing of molded fiber-reinforced synthetic plastic material, one side of which is firmly connected with the base plate by bolts, wherein the lock mechanism has a servo drive with a servo drive body made of synthetic plastic material, the improvement comprising said housing, in the assembled lock, being open at a side opposite that at which the base plate is connected, the servo drive body and the housing being formed of a one-piece molded part and all operating levers of the lock mechanism being carried by one of the housing and base plate.

2. In an automobile door lock according to claim 1, wherein the servo drive is a pneumatic servo drive and the servo drive housing forms a servo drive cylinder thereof.

3. In an automobile door lock according to claim 2, wherein the servo drive is an electrical servo drive and the servo drive housing forms a servo drive housing thereof.

4. In an automobile door lock according to claim 1, the further improvement wherein the housing is provided with at least one angularly projecting support arm, for cooperation with a control element of a servo drive, as an integrally molded part thereof.

5. In an automobile door lock according to claim 1, the further improvement wherein the housing is provided with integrally molded mountings for bearing pins made of synthetic plastic material.

6. In an automobile door lock according to claim 1, the further improvement wherein the housing is provided with integrally molded mountings for bearing pins made of synthetic plastic material.

7. In an automobile door lock according to claim 1, the further improvement wherein the housing is provided with bearing pins made of synthetic material, the bearing pins and housing being formed of a one-piece molded part.

* * * * *